US005778476A

United States Patent [19]

Squillaci et al.

[11] Patent Number: 5,778,476

[45] Date of Patent: Jul. 14, 1998

[54] INTERDENTAL BRUSHES HAVING ROUGHENED, TAPERED AND ROUNDED BRISTLE ENDS AND METHOD OF MAKING THE SAME

[75] Inventors: Dominic Squillaci, Lake Villa; Scott Koepsel, Waukegan; John Shimkus, Boilingbrook; Kiyoshi Maekawa, Mount Prospect, all of Ill.

[73] Assignee: John O. Butler Company, Inc., Chicago, Ill.

[21] Appl. No.: 671,788

[22] Filed: Jun. 20, 1996

Related U.S. Application Data

[62] Division of Ser. No. 613,589, Mar. 12, 1996.

[51] Int. Cl.[6] ..... A46B 9/04

[52] U.S. Cl. ..... 15/167.1; 15/206; 15/207.2

[58] Field of Search ..... 15/167.1, 206, 15/207.2, DIG. 5

[56] References Cited

U.S. PATENT DOCUMENTS

| | | | |
|---|---|---|---|
| 1,643,217 | 9/1927 | Lazarus | 15/206 |
| 2,587,792 | 3/1952 | Von Sivers | 15/207.2 |
| 2,607,064 | 8/1952 | Sullivan et al. | 15/207.2 |
| 3,720,975 | 3/1973 | Nelson | 15/167.1 |
| 4,288,883 | 9/1981 | Dolinsky | 15/207.2 |
| 4,387,479 | 6/1983 | Kigyos | 15/206 |
| 4,395,943 | 8/1983 | Brandli | 15/206 |
| 5,305,489 | 4/1994 | Lage | 15/207.2 |
| 5,542,439 | 8/1996 | Gueret | 15/207.2 |
| 5,678,275 | 10/1997 | Defner | 15/167.1 |
| 5,699,578 | 12/1997 | Dumler et al. | 15/167.1 |

FOREIGN PATENT DOCUMENTS

| | | | |
|---|---|---|---|
| 2541100 | 8/1984 | France | 15/207.2 |

*Primary Examiner*—Terrence Till

*Attorney, Agent, or Firm*—Laff, Whitesel Conte & Saret, Ltd.

[57] ABSTRACT

An interdental twisted wire brush having roughened, tapered and rounded bristle ends prepared by rotating the interdental brush both transversely to the axis of the brush and axially along its longitudinal axis, while flexing the bristles and grinding the bristle ends of the interdental brush against a flat, moving abrasive surface.

10 Claims, 7 Drawing Sheets

INTERDENTAL BRUSHES HAVING ROUGHENED, TAPERED AND ROUNDED BRISTLE ENDS AND METHOD OF MAKING THE SAME

This application is a division, of prior application Ser. No. 08/613,589, filed Mar. 12, 1996, pending.

FIELD OF THE INVENTION

This invention relates generally to interdental brushes and, more particularly, to interdental twisted wire brushes having roughened, tapered and rounded bristle ends.

BACKGROUND OF THE INVENTION

The brushing of teeth serves at least two important purposes, removing plaque and debris from the teeth and massaging mouth tissue. Removing plaque and debris discourages the formation of caries. Massaging mouth tissue causes the gums to develop a thicker and healthier surface layer for resisting attack from both disease and mechanical abrasion. Unfortunately, conventional toothbrushes cannot reach many tooth and gum surfaces. For example, the interdental spaces between and around the teeth as well as at the gum line are difficult to reach with conventional toothbrushes. Therefore, conventional toothbrushes may not remove plaque or massage mouth tissue to the degree desirable.

Interdental twisted wire brushes are commonly used to compensate for this shortcoming in conventional toothbrushes because the twisted wire brushes are able to fit within and through the interdental spaces. Twisted wire brushes, such as those disclosed in U.S. Pat. No. 4,395,943 (Brandli), comprise a twisted stainless steel double wire with bristles inserted between the twists in the wire. The bristles, which may be formed of a suitable material such as nylon, extend radially from the wire.

The most common current method of producing interdental twisted wire brushes involves inserting the bristles and scissor-cutting the bristle ends. However, because scissor-cutting may result in bristle ends **25*b* with uneven surfaces 27 having potentially sharp edges 29 (see FIG. 8**), in some cases bristles of this nature may not be optimal for cleaning the teeth and massaging the gum tissue.

There are methods available for shaping the ends of bristles, such as abrasive working. For example, German Patent No. 19500145.1 discloses a device for rounding the ends of plastic bristles. In this device, a circular brush is inserted into a hollow cylinder having an abrasive inner surface. A relative rotary movement and a reversible relative axial movement is then created between the brush and the cylinder to round the bristle ends. A representative endrounded bristle **25*a* produced in accordance with current methods is shown in FIG. 7. As illustrated in this figure, only the very end 31 of the bristle is rounded to eliminate the uneven surface. The overall width 33** of the bristle remains the same.

Unfortunately, both conventional scissor-cut and current endrounded bristles suffer from further limitations. For example, scissor-cutting produces bristle ends which have intersecting, smooth, glass-like surfaces. Teeth cleaning is not very effective with bristle ends having this type of surface due to the lack of friction between the interdental brush bristle ends and the teeth. The uniform width of both scissor-cut and current endrounded bristles also inhibits the individual bristles from fitting into the small, irregular surfaces and crevices found in teeth and at the gum line.

Moreover, because neither scissor-cut nor current endrounded bristles are able to adequately penetrate smaller interdental spaces, many tooth surfaces cannot be reached.

SUMMARY OF THE INVENTION

In the present invention an interdental twisted wire brush is rotated both transversely to the axis of the brush and axially along its longitudinal axis, while the bristles of the brush are pressed with their ends against a flat, moving abrasive surface so that the individual bristles are flexed or bowed from their normal straight configuration. The flat, moving abrasive surface may either be an abrasive belt or an abrasive disc. When an abrasive belt is used, preferably the belt will not only move in the conventional fashion—longitudinally on rollers—but will also rotate transversely to the axis of the brush along a line passing through the portion of the belt which engages the brush and is located between the rollers. When an abrasive disc is utilized, the disc spins transversely to the axis of the brush along the disc's center of rotation as it simultaneously revolves along a center point adjacent to the center of rotation of the disc.

The friction between the abrasive surface and the bristle ends in conjunction with the transverse and axial rotation of the interdental brush (and, when an abrasive disc is utilized, the dual action of the disc), causes the bristle ends to roll in a circular path against the abrasive surface, resulting in a roughened, tapered and rounded configuration of each interdental brush bristle end. The resulting bristle ends produce enhanced penetration of small interdental spaces and improved cleaning and massaging of teeth and gums without scarring gum tissue.

DETAILED DESCRIPTION OF THE INVENTION

The present invention is directed to a method for roughening, tapering and rounding the bristle ends of an interdental twisted wire brush wherein the interdental brush is rotated both transversely to the axis of the brush and axially along its longitudinal axis, while the bristle ends of the interdental brush are pressed to the point of flexure against a flat, moving abrasive surface. The method of the invention is designed to either follow or replace scissor-cutting in conventional interdental brush-making.

Figure 1:
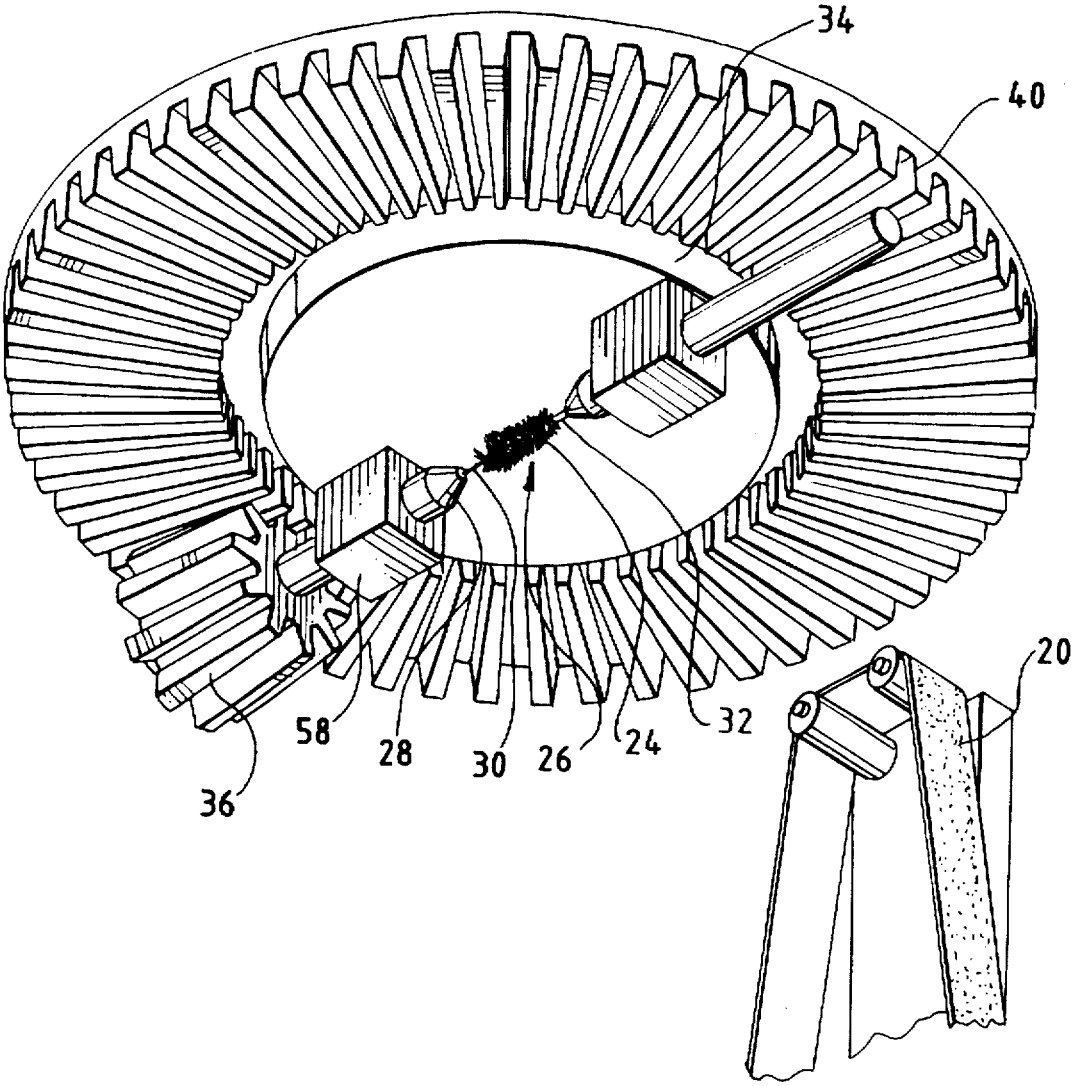
FIG. 1 is a perspective view of one embodiment of the invention including an abrasive belt.
Figure 2:
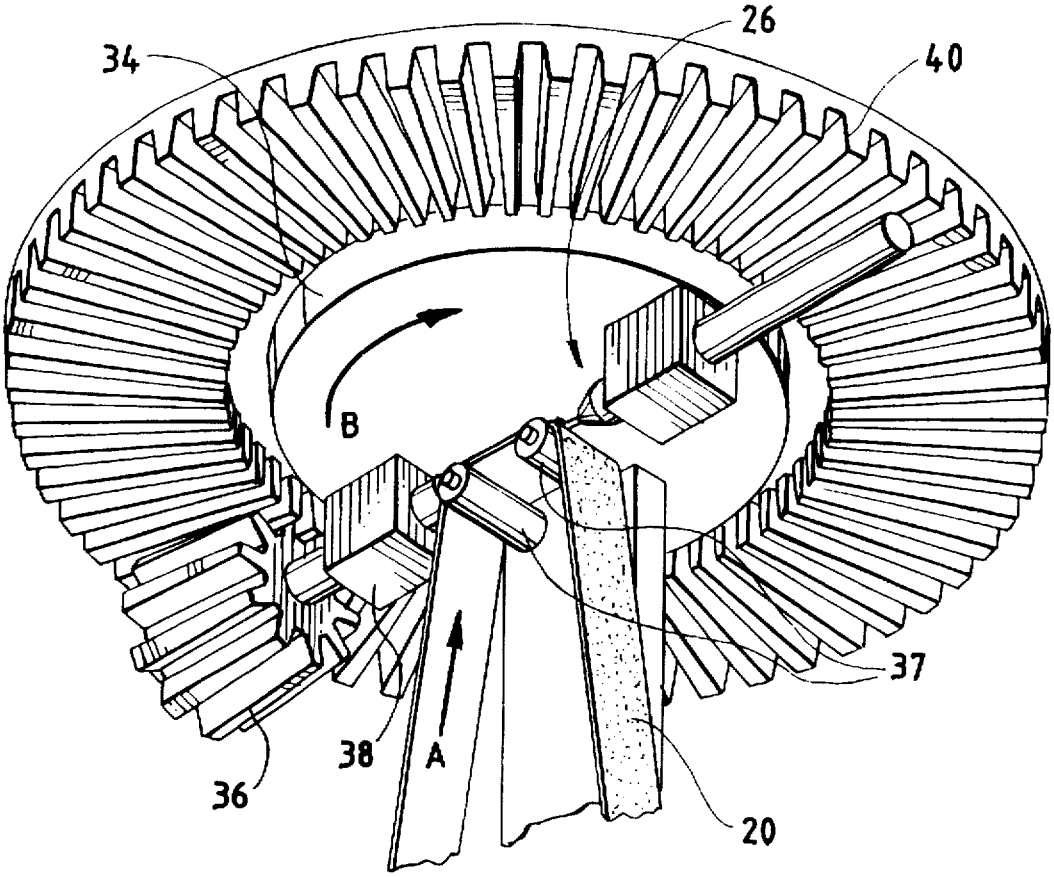
FIG. 2 is a perspective view of the invention shown in FIG. 1 with the abrasive belt in position.
Figure 3:
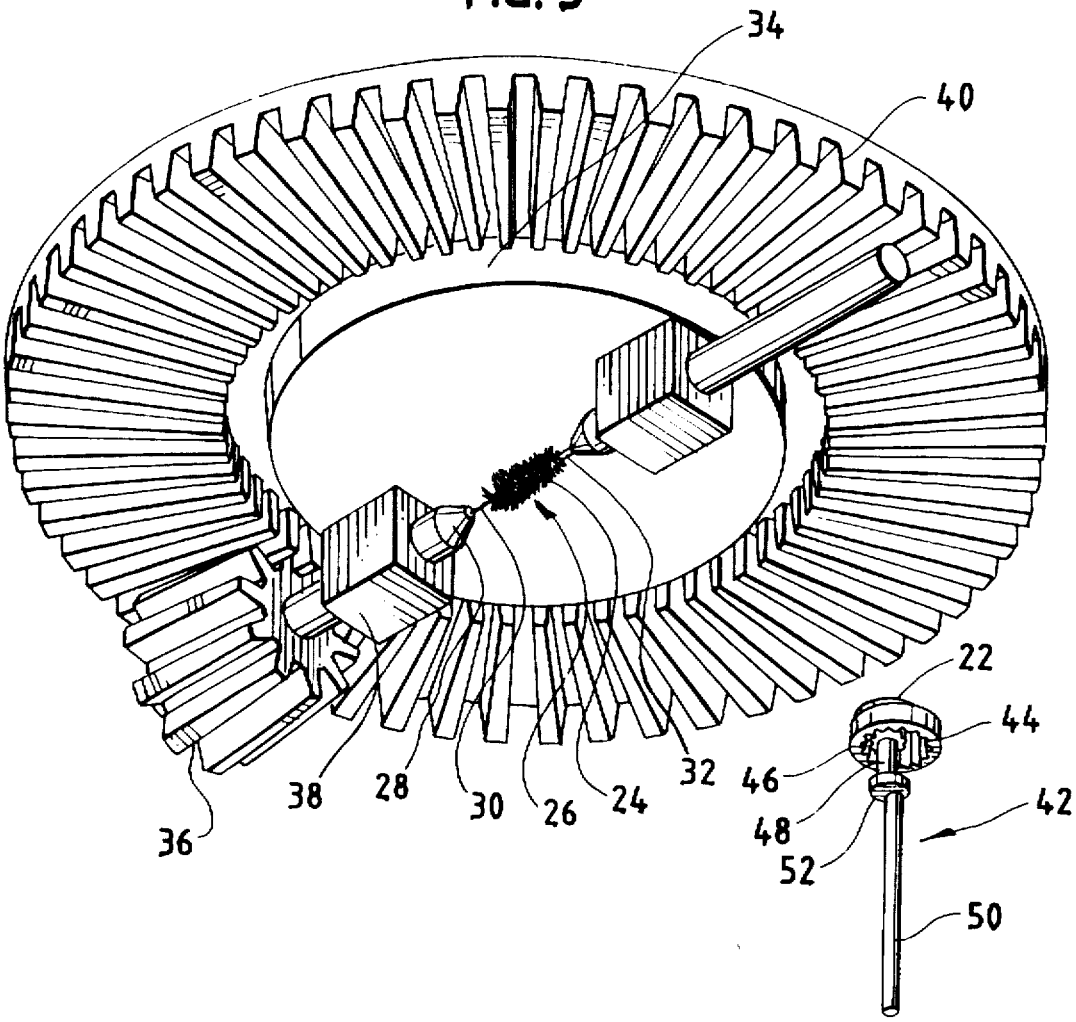
FIG. 3 is a perspective view of another embodiment of the invention including an abrasive disc.
Figure 4:
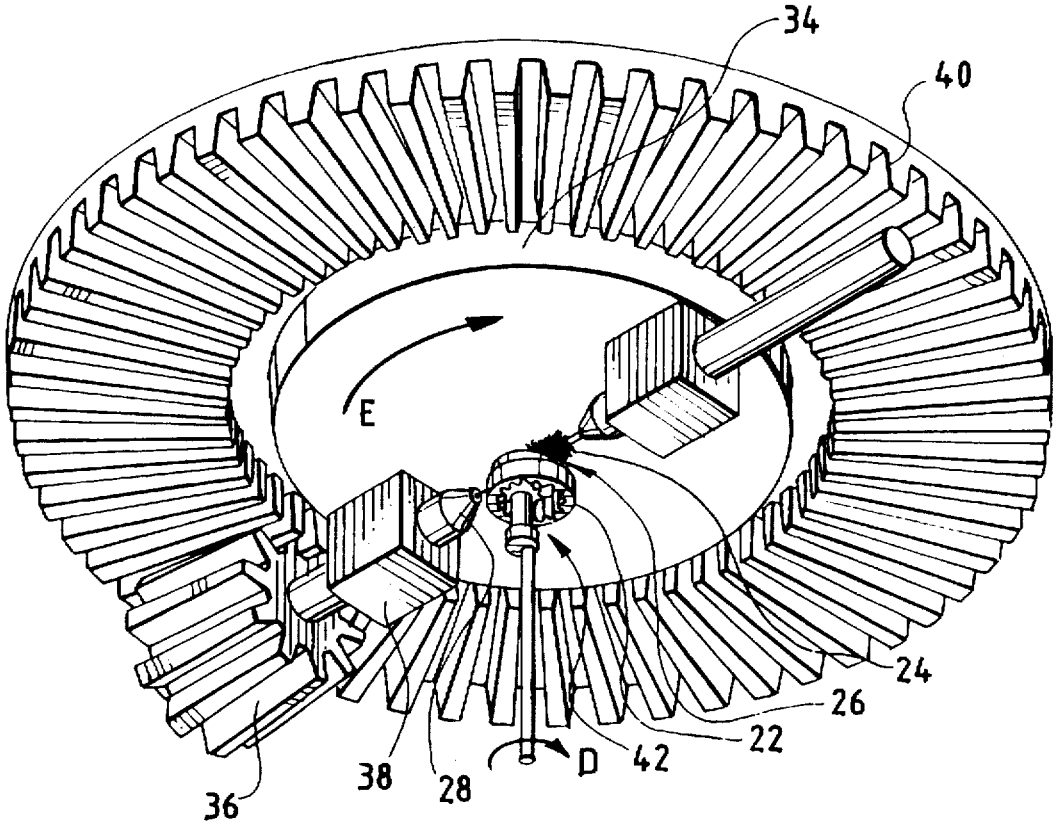
FIG. 4 is a perspective view of the invention shown in FIG. 3 with the abrasive disc in position.

In accordance with the invention, the flat, moving abrasive surface may either be an abrasive belt 20, as shown in FIGS. 1 and 2, or an abrasive disc 22, as shown in FIGS. 3 and 4. A conventional abrasive material, such as silicon carbide, sapphire or diamond, is applied to the belt or disc. The abrasive belt 20 or disc 22 should have a surface area sufficient to insure that it contacts all of the interdental brush bristle ends.

In accordance with one embodiment of the invention, illustrated in FIG. 1, abrasive belt 20 is used to grind the bristle ends 24 of an interdental brush 26. Interdental brush 26 is held in a lateral position by a chuck 28 located at the twisted wire portion 30 of the brush below the bristles and by a pin 32 located at the tip of the brush above the bristles having a dimple (not shown) which receives the brush tip. The abrasive belt 20 is then moved into position against the interdental brush 26, as shown in FIG. 2, to flex the bristles to produce tapering of the bristle ends.

Figure 5:
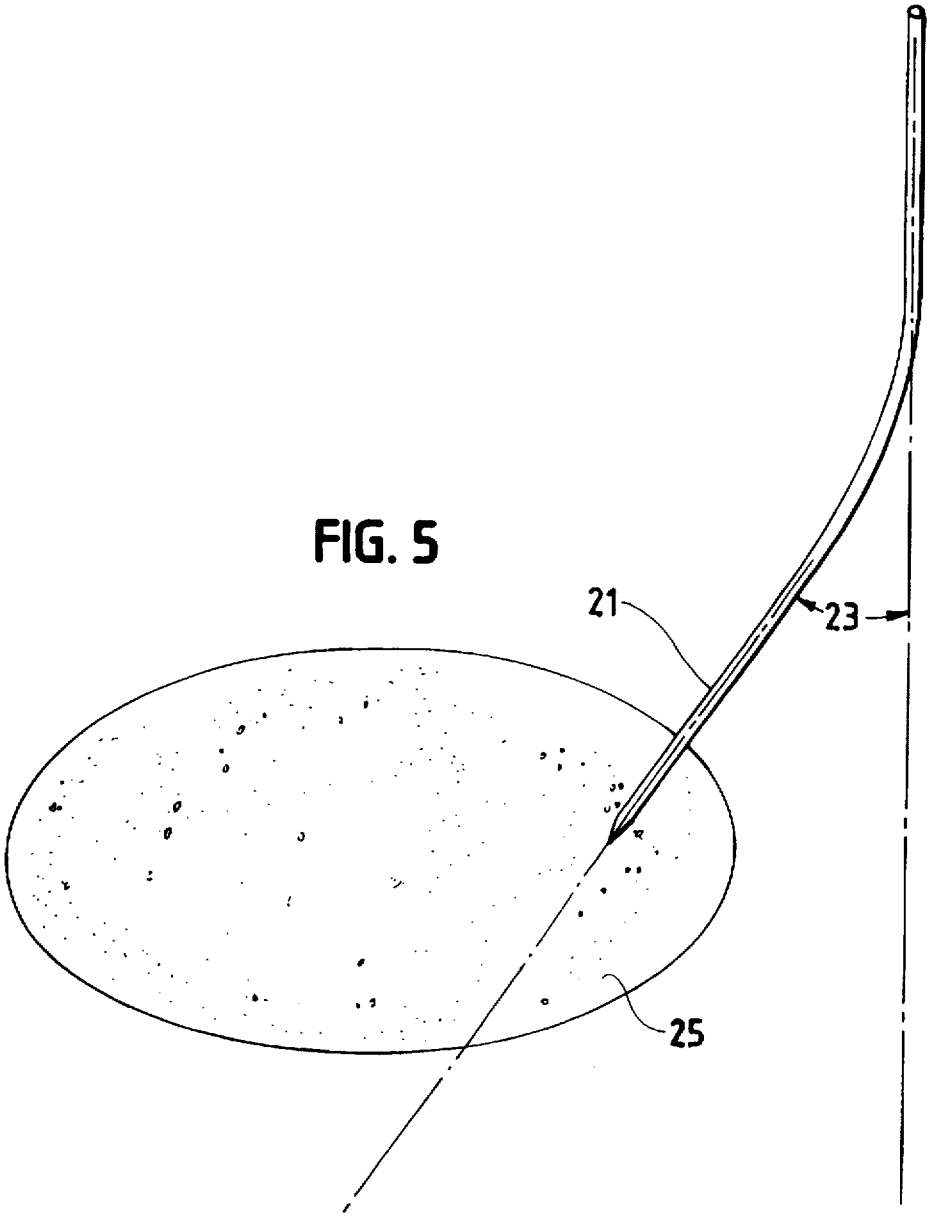
FIG. 5 is a front elevation view of a bristle flexed against an abrasive surface.

Although the degree of flexure may vary depending, for example, upon the thickness and length of the bristles, it is preferred that the bristles be flexed from their normal straight configuration to an angle of not more than about 85°. FIG. 5 shows a single bristle 21 flexed from its normal straight configuration to an angle 23 against an abrasive surface 25.

Figure 9:
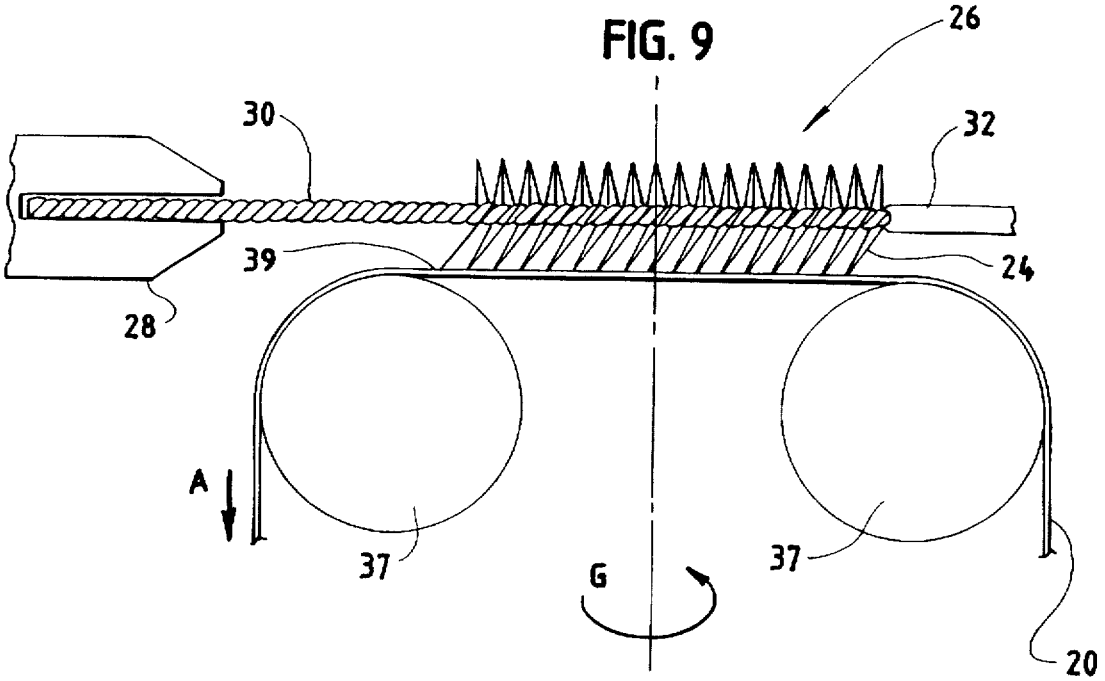
FIG. 9 is a front elevation view of interdental brush bristles flexed against an abrasive belt.

The abrasive belt 20, which moves on rollers 37, is driven by an independent motor (not shown) in the direction of arrow A, as shown in FIGS. 2 and 9, preferably at a speed in the range of about 70 to 1300 ft/min. It is also preferred that the abrasive belt 20 be simultaneously rotated transversely to the axis of the interdental brush 26 along a line passing generally perpendicularly through the portion 39 of the belt which engages the brush and is located between the rollers 37. A separate independent motor (not shown) rotates the belt, preferably in a counter-clockwise direction, as shown by arrow G, in FIG. 9.

Once the abrasive belt 20 is in position and running, the interdental brush 26 is rotated transversely to the axis of the brush in the direction of arrow B by a revolving plate 34, as shown in FIG. 2. The revolving plate 34, which is driven by an independent motor (not shown), transversely rotates the brush 26 to ensure that the full circumference of each bristle end is contacted by the abrasive belt 20. It is preferred that the transverse rotation of the interdental brush be in the range of about 50 to 400 rpm.

Revolving plate 34 is attached to a pinion gear 36 by a bearing block 38. The revolving-motion of plate 34 causes pinion gear 36 to rotate in the direction of arrow C around a stationary bevel gear 40, which in turn, causes chuck 28 and interdental brush 26 to rotate axially. This axial rotation of brush 26 along its longitudinal axis allows the full circumference of the brush to come into contact with the abrasive belt 20. It is preferred that the ratio of the longitudinal rotation of the interdental brush to the transverse rotation be about 6:1.

Figure 6:
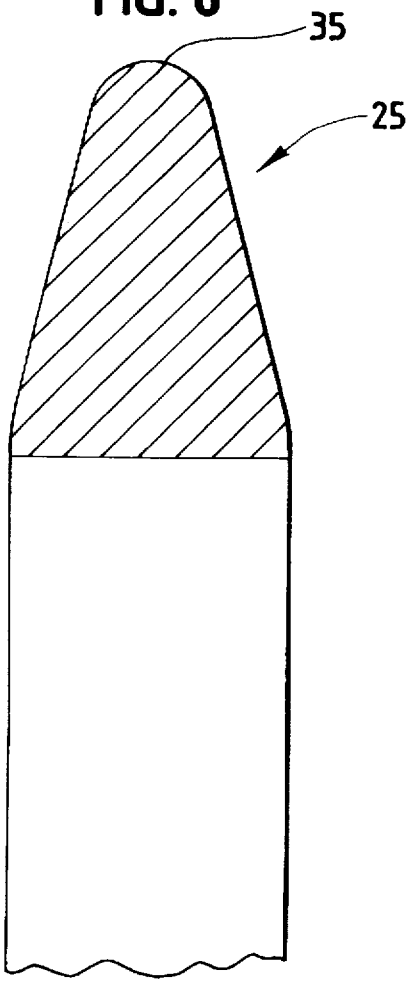
FIG. 6 is a front elevation view of a bristle end produced in accordance with the invention.

The friction between the abrasive belt 20 and the bristles 24 in conjunction with the transverse and axial rotation of the interdental brush 26 causes the flexed bristles to roll in a circular path against the abrasive belt, thus resulting in a roughened, tapered and rounded configuration of each interdental brush bristle end. A bristle end 25 produced in accordance with the present invention is shown in FIG. 6.

Figure 7:
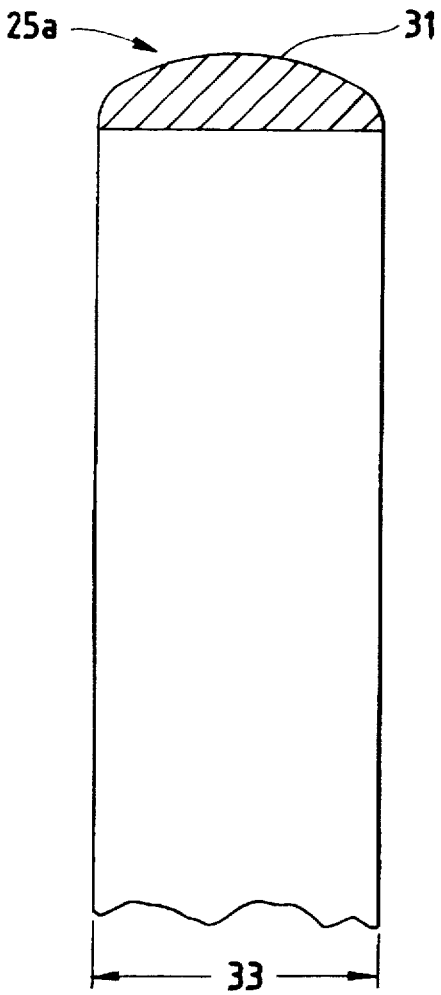
FIG. 7 is a front elevation view of a rounded bristle end.
Figure 8:
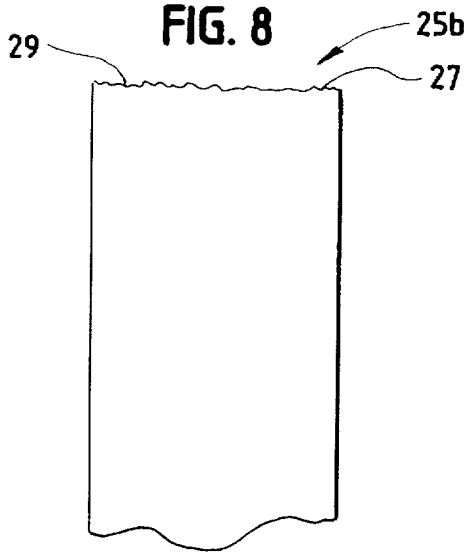
FIG. 8 is a front elevation view of a scissor-cut bristle end.

Unlike the conventional scissor-cut bristle end 25*b* illustrated in FIG. 8 with its uneven surface 27 and sharp edges 29, the inventive bristle end 25 has a roughened and rounded end 35, which effectively cleans and massages teeth and gums without scarring gum tissue. Moreover, unlike scissor-cut bristle end 25*b* and bristle end 25*a* shown in FIG. 7, in which only the very end 31 of the bristle has been rounded, the inventive bristle end 25 is tapered so that it can fit into the small, irregular surfaces and crevices found in teeth and at the gum line. The overall design of the bristle end 25 additionally enhances penetration of small interdental spaces.

In another embodiment of the present invention, abrasive disc 22 is used to grind the bristle ends 24 of an interdental brush 26, as shown in FIGS. 3 and 4. The abrasive disc 22 is part of an abrasive disc assembly 42 wherein the abrasive disc 22 is attached to a planetary gear 44 contained within a stationary gear 46. The planetary gear 44 has a shaft 48, which is connected to a motorized shaft 50 by an offset cam 52. As shown in FIG. 4, the abrasive disc assembly 42 is driven by an independent motor (not shown) in the direction of arrow D (FIG. 4), i.e., clockwise about the axis of the motorized shaft 50. Simultaneously, the stationary gear 46 causes the planetary gear 44 and abrasive disc 22 to rotate in a counter-clockwise direction about the axis of the planetary shaft 48. Thus, the abrasive disc spins transversely to the axis of the interdental brush 26 along the disc's center of rotation as it simultaneously revolves along a center point adjacent to the center of rotation.

As in the method illustrated in FIGS. 1 and 2, the interdental brush 26 is held in a lateral position by chuck 28 located at the twisted wire portion 30 of the brush below the bristles and by pin 32 located at the tip of the brush above the bristles having a dimple (not shown) which receives the brush tip. The abrasive disc assembly 42 is then moved into position with the abrasive disc 22 against the interdental brush 26, as shown in FIG. 4, to flex the bristles to produce tapering of the bristle ends. Although the degree of flexure may vary depending, for example, upon the thickness and length of the bristles, it is preferred that the bristles be flexed from their normal straight configuration to an angle of not more than about 85°. FIG. 5 shows a single bristle 21 flexed from its normal straight configuration to an angle 23 against an abrasive surface 25.

Once the abrasive disc assembly 42 is in position and running, the interdental brush 26 is rotated transversely to the axis of the brush in the direction of arrow E by revolving plate 34, as shown in FIG. 4. The revolving plate 34, which is driven by an independent motor (not shown), transversely rotates the brush 26 to ensure that the full circumference of each bristle end is contacted by the abrasive disc 22. It is preferred that the transverse rotation of the interdental brush be in the range of about 50 to 400 rpm.

As in the previously described method, revolving plate 34 is attached to pinion gear 36 by bearing block 38. The revolving motion of plate 34 causes pinion gear 36 to rotate in the direction of arrow F around a stationary bevel gear 40, which in turn, causes chuck 28 and interdental brush 26 to rotate axially. This axial rotation of brush 26 along its longitudinal axis allows the full circumference of the brush to come into contact with the abrasive disc 22. It is preferred that the ratio of the longitudinal rotation of the interdental brush to the transverse rotation be about 6:1.

The transverse and axial rotation of the interdental brush, the friction between the abrasive disc and the flexed bristles, and the dual action of the abrasive disc effectively roll the bristles in a circular path against the spinning abrasive disc, thus resulting in a roughened, tapered, and rounded configuration of each interdental brush bristle end.

Like the bristle ends produced in accordance with the abrasive belt method, the bristle ends produced in accordance with the abrasive disc method offer several advantages over the prior art bristle ends 25*a*, 25*b* (FIGS. 7 and 8). The roughened, tapered and rounded configuration of each bristle end 25 (FIG. 6) results in improved cleaning and massaging of teeth and gums without scarring gum tissue, as well as in enhanced penetration of small interdental spaces.

While the present invention is described above in connection with preferred or illustrative embodiments, these embodiments are not intended to be exhaustive or limiting of the invention. Rather, the invention is intended to cover all alternatives, modifications, and equivalents included within its spirit and scope, as defined by the appended claims.

What is claimed is:

1. An interdental twisted wire brush having roughened, tapered and rounded bristle ends prepared by:

a) rotating the interdental brush transversely to the axis of the brush;

b) rotating the interdental brush along the longitudinal axis of the brush;

c) grinding the bristle ends of the interdental brush against a flat, moving abrasive surface; and d) flexing the bristle ends against the abrasive surface.

2. The interdental brush of claim 1 wherein the transverse rotation of the interdental brush is in the range of about 50 to about 400 rpm.

3. The interdental brush of claim 1 wherein the ratio of the longitudinal rotation of the interdental brush to the transverse rotation is about 6:1.

4. The interdental brush of claim 1 wherein the abrasive surface is chosen from the group consisting of silicon carbide, sapphire and diamond.

5. The interdental brush of claim 1 wherein the flat, moving abrasive surface is an abrasive belt.

6. The interdental brush of claim 5 wherein the abrasive belt operates at a speed in the range of about 70 to about 1300 ft/min.

7. The interdental brush of claim 5 further comprising rotating the abrasive belt transversely to the axis of the brush along a line passing generally perpendicularly through the portion of the belt which engages the brush.

8. The interdental brush of claim 1 wherein the flat, moving abrasive surface is an abrasive disc.

9. The interdental brush of claim 8 further comprising spinning the abrasive disc transversely to the axis of the brush along the center of rotation of the disc and revolving the disc along a center point adjacent to the center of rotation.

10. An interdental twisted wire brush having bristles with tapered, rounded and roughened bristle ends.

* * * * *